US010423176B2

(12) United States Patent
Pan et al.

(10) Patent No.: US 10,423,176 B2
(45) Date of Patent: Sep. 24, 2019

(54) LOW-DROPOUT REGULATORS

(71) Applicant: Yangtze Memory Technologies Co., Ltd., Wuhan, Hubei (CN)

(72) Inventors: Feng Pan, Hubei (CN); Zhenyu Lu, Hubei (CN); Steve Weiyi Yang, Hubei (CN); Simon Shi-Ning Yang, Hubei (CN)

(73) Assignee: Yangtze Memory Technologies Co., Ltd., Wuhan (CN)

( * ) Notice: Subject to any disclaimer, the term of this patent is extended or adjusted under 35 U.S.C. 154(b) by 0 days.

(21) Appl. No.: 16/046,841

(22) Filed: Jul. 26, 2018

(65) Prior Publication Data

US 2019/0064862 A1 Feb. 28, 2019

Related U.S. Application Data

(63) Continuation of application No. PCT/CN2018/077711, filed on Mar. 1, 2018.

(30) Foreign Application Priority Data

Mar. 8, 2017 (CN) ..... 2017 1 0135653

(51) Int. Cl.
*G05F 1/575* (2006.01)
*G05F 1/56* (2006.01)

(52) U.S. Cl.
CPC ..... *G05F 1/575* (2013.01); *G05F 1/561* (2013.01)

(58) Field of Classification Search
CPC ... G05F 1/56; G05F 1/575; G05F 1/59; G05F 1/595
See application file for complete search history.

(56) References Cited

U.S. PATENT DOCUMENTS 5,552,697 A 9/1996 Chan
6,046,624 A 4/2000 Nam et al.
(Continued)

FOREIGN PATENT DOCUMENTS

CN 102117089 A 7/2011
CN 103064455 A 4/2013
(Continued)

OTHER PUBLICATIONS

International Search Report and Written Opinion of the International Searching Authority directed to related International Patent Application No. PCT/CN2018/077711, dated May 30, 2018, with attached English-language translation; 9 pages.

*Primary Examiner* — Matthew V Nguyen
(74) *Attorney, Agent, or Firm* — Sterne, Kessler, Goldstein & Fox P.L.L.C.

(57) ABSTRACT

A low-dropout regulator comprises a first switching transistor, a comparator, and a Miller capacitor. The first terminal of the first switching transistor is connected to a load, and the second terminal of the first switching transistor is connected to a power supply voltage. The first input terminal of the comparator is connected to a reference voltage, the second input terminal of the comparator is connected to the first terminal of the first switching transistor, and the output terminal of the comparator is connected to the control terminal of the first switching transistor. The first terminal of the Miller capacitor is connected to the control terminal of the first switching transistor, and the second terminal of the Miller capacitor is connected to the first terminal of the first switching transistor and the load.

18 Claims, 4 Drawing Sheets

(56) References Cited

U.S. PATENT DOCUMENTS

| | | | | |
|---|---|---|---|---|
| 6,518,737 | B1 | 2/2003 | Stanescu et al. | |
| 6,600,299 | B2 | 7/2003 | Xi | |
| 7,095,257 | B2 | 8/2006 | Whittaker | |
| 7,248,531 | B2 | 7/2007 | Pyeon et al. | |
| 7,710,091 | B2 | 5/2010 | Huang | |
| 8,872,492 | B2 * | 10/2014 | Zhang | G05F 1/575 323/280 |
| 9,552,004 | B1 * | 1/2017 | Dixit | G05F 1/56 |
| 9,577,613 | B2 | 2/2017 | Yang et al. | |
| 2007/0159146 | A1 | 7/2007 | Mandal | |
| 2014/0159683 | A1 * | 6/2014 | Pan | G05F 1/10 323/280 |
| 2016/0173066 | A1 * | 6/2016 | Yang | H03K 19/0013 327/109 |
| 2017/0060157 | A1 * | 3/2017 | Jefremow | H02M 3/155 |
| 2017/0090495 | A1 * | 3/2017 | Ramos | G05F 1/575 |
| 2017/0364110 | A1 * | 12/2017 | Golara | G05F 1/573 |
| 2018/0120882 | A1 | 5/2018 | Zhang et al. | |
| 2019/0064862 | A1 | 2/2019 | Pan et al. | |

FOREIGN PATENT DOCUMENTS

| | | | |
|---|---|---|---|
| CN | 103268134 | A | 8/2013 |
| CN | 103713682 | A | 4/2014 |
| CN | 103744803 | A | 4/2014 |
| CN | 104881070 | A | 9/2015 |
| CN | 104950974 | A | 9/2015 |
| CN | 104076854 | B | 2/2016 |
| CN | 105700605 | A | 6/2016 |
| CN | 106206590 | A | 12/2016 |
| CN | 106708153 | A | 5/2017 |
| TW | 357360 | B | 5/1999 |
| TW | I-275919 | B | 3/2007 |
| TW | I-430277 | B | 3/2014 |

* cited by examiner

LOW-DROPOUT REGULATORS

CROSS-REFERENCE TO RELATED APPLICATIONS

This application claims priority to PCT/CN2018/077711 filed on Mar. 1, 2018, which claims priority to Chinese Patent Application No. 201710135653.4, filed on Mar. 8, 2017, the entire contents of which are incorporated herein by reference.

TECHNICAL FIELD

The present disclosure generally relates to the field of semiconductor circuit technology, and more particularly, to low-dropout regulators.

BACKGROUND

A low-dropout regulator (LDO) is a direct current (DC) linear voltage regulator that can regulate the output voltage even when the supply voltage is very close to the output voltage. As semiconductor technology advances, the designing of LDOs has become a critical aspect of the manufacturing process of three-dimensional (3D) NAND flash memories, in which the memory cells are stacked vertically in multiple layers to achieve higher densities at a lower cost per bit.

Conventional analog LDOs are widely used in a variety of circuit structures. In order to ensure the output stability of the LDOs under different load conditions, a high quiescent power and a large decoupling capacitance are important. Existing analog LDOs have a low bandwidth and a slow load transient response speed. On the other hand, existing digital LDOs also have drawbacks, such as higher noise, higher switching power, complex architecture, and complicated algorithm control.

Accordingly, the disclosed low-dropout regulators are directed to solve one or more problems set forth above, and other problems.

BRIEF SUMMARY

In accordance with some embodiments of the present disclosure, low-dropout regulators are provided.

In some embodiments, a low-dropout regulator has a first switching transistor, a comparator and a Miller capacitor. The a first switching transistor has a first terminal, a second terminal and a control terminal, and the first terminal of the first switching transistor is connected to a load, and the second terminal of the first switching transistor is connected to a power supply voltage. The comparator has a first input terminal, a second input terminal and an output terminal, and the first input terminal of the comparator is connected to a reference voltage, the second input terminal of the comparator is connected to the first terminal of the first switching transistor, and the output terminal of the comparator is connected to the control terminal of the first switching transistor. The Miller capacitor has a first terminal and a second terminal, and the first terminal of the Miller capacitor is connected to the control terminal of the first switching transistor, and the second terminal of the Miller capacitor is connected to the first terminal of the first switching transistor and the load.

The low-dropout regulator further can include a driving module including an input and an output, and the input of the driving module is coupled to the output terminal of the comparator, and the output of the driving module is coupled to the control terminal of the first switching transistor.

The driving module can further include a p-channel metal-oxide-semiconductor field-effect transistor (P-MOSFET) connected to an n-channel metal-oxide-semiconductor field-effect transistor (N-MOSFET). A source of the P-MOSFET is connected to the power supply voltage, a drain of the P-MOSFET is connected to the control terminal of the first switching transistor, and a gate of the P-MOSFET is connected to the output terminal of the comparator. And a gate of the N-MOSFET is connected to the output terminal of the comparator, a source of the N-MOSFET is coupled to a ground voltage potential, and a drain of the N-MOSFET is connected to the control terminal of the first switching transistor.

The driving module can further include a first inverter including an input terminal and an output terminal, and the input terminal of the first inverter is connected to the output terminal of the comparator, and the output terminal of the first inverter is connected to the control terminal of the first switching transistor.

The driving module can further include a p-channel metal-oxide-semiconductor field-effect transistor (P-MOSFET), an n-channel metal-oxide-semiconductor field-effect transistor (N-MOSFET), a first current source, and a second current source. A drain of the P-MOSFET is connected to the control terminal of the first switching transistor, and a gate of the P-MOSFET is connected to the output terminal of the comparator. An input terminal of the first current source is connected to the power supply voltage, and an output terminal of the first current source is connected to the source of the P-MOSFET. A gate of the N-MOSFET is connected to the output terminal of the comparator, a source of the N-MOSFET is coupled to a ground voltage potential, and a drain of the N-MOSFET is connected to the control terminal of the first switching transistor. An input terminal of the second current source is connected to the source of the N-MOSFET, and an output terminal of the second current source is coupled to a ground voltage potential.

The driving module can further include a first inverter including an input terminal and an output terminal, and the input terminal of the first inverter is connected to the output terminal of the comparator, and the output terminal of the first inverter is connected to the gate of the P-MOSFET and the gate of the N-MOSFET.

The driving module can further include a second inverter, and an input terminal of the second inverter is connected to the output terminal of the comparator, and an output terminal of the second inverter is connected to the input terminal of the first inverter.

The first inverter can include an inverting buffer or an inverting amplifier.

A capacitance value of the Miller capacitor can be less than a capacitance value of an equivalent capacitance of the load, and can be greater than a capacitance value of a parasitic capacitance at the control terminal of the first switching transistor.

The capacitance value of the Miller capacitor can be less than or equal to one percent of the capacitance value of the equivalent capacitor of the load, and can be greater than or equal to ten times of the capacitance value of the parasitic capacitance at the control terminal of the first switching transistor.

The first switching transistor can include a p-channel metal-oxide-semiconductor field-effect transistor (P-MOSFET).

The Miller capacitor can have a withstand voltage of about 100 mV and a capacitance of about 400 pF.

A voltage slew rate of the low-dropout regulator is determined by an output voltage of the low-dropout regulator and an equivalent capacitance of the load.

The first terminal of the first switching transistor can be a non-dominant pole, while the control terminal of the first switching transistor can be a dominant pole.

The input terminal of the first inverter and the output terminal of the first inverter can be non-dominant poles.

The input terminal of the second inverter and the output terminal of the second inverter can be non-dominant poles.

Another aspect of the present disclosure discloses another low-dropout regulator including a first switching transistor configured to control a switching between a power supply and a load of the low-dropout regulator in response to a control signal, a comparator configured to compare an output voltage of the first switching transistor and a reference voltage, and the control signal is generated based on an output signal of the comparator, and a Miller capacitor electrically connected between a control terminal and an output terminal of the first switching transistor, and configured to stabilize an output voltage of the low-dropout regulator to the load.

The low-dropout regulator can further include a driving module configured to driving the output signal of the comparator to generate the control signal, to buffer the control signal for increasing a stability of the output voltage of the low-dropout regulator to the load.

The driving module can include a complementary metal oxide-semiconductor (CMOS) inverter configured to increase noise margins of the output voltage of the low-dropout regulator to the load.

The driving module can further include one or more current sources configured adjust a changing rate of the output voltage of the low-dropout regulator to the load, such as a first current source configured to limit a boost speed of the output voltage of the low-dropout regulator to the load, and/or a second current source configured to limit a buck speed of the output voltage of the low-dropout regulator to the load.

The driving module can further include one or more digital inverters configured to amplify and/or to buffer the output signal of the comparator.

Another aspect of the present disclosure provides a system for supplying power to word lines of a three-dimensional (3D) NAND flash memory device. The system has a charge pump configured to elevate an initial voltage to a power supply voltage that is higher than the initial voltage; an oscillator configured to generate periodic clock and drive stage capacitors in the charge pump; and a disclosed low-dropout regulator configured to regulate the power supply voltage for outputting a driving voltage to a word line of the three-dimensional (3D) NAND flash memory device.

Other aspects of the present disclosure can be understood by those skilled in the art in light of the description, the claims, and the drawings of the present disclosure.

BRIEF DESCRIPTION OF THE DRAWINGS

The accompanying drawings, which are incorporated herein and form a part of the specification, illustrate embodiments of the present disclosure and, together with the description, further serve to explain the principles of the present disclosure and to enable a person skilled in the pertinent art to make and use the present disclosure.

Embodiments of the present disclosure will be described with reference to the accompanying drawings.

DETAILED DESCRIPTION

Although specific configurations and arrangements are discussed, it should be understood that this is done for illustrative purposes only. A person skilled in the pertinent art will recognize that other configurations and arrangements can be used without departing from the spirit and scope of the present disclosure. It will be apparent to a person skilled in the pertinent art that the present disclosure can also be employed in a variety of other applications.

It is noted that references in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it would be within the knowledge of one skilled in the art to effect such feature, structure or characteristic in connection with other embodiments whether or not explicitly described.

In general, terminology may be understood at least in part from usage in context.

For example, terms, such as "and," "or," or "and/or," as used herein may include a variety of meanings that may depend at least in part upon the context in which such terms are used. Typically, "or" if used to mean at least one of a list, such as A, B or C, but can include more than one or all of A, B and C. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

As discussed in the background section, both existing analog low-dropout regulators (LDOs) and digital LDOs have drawbacks. In accordance with various embodiments, the present disclosure provides low-dropout regulators based on a digital-assisted analog LDO approach to combine the design metrics of the traditional analog LDO architecture and the existing digital LDO architecture. The disclosed low-dropout regulators can achieve high bandwidth, small quiescent current, small decoupling capacitance, low power, and acceptable noise.

Figure 1:
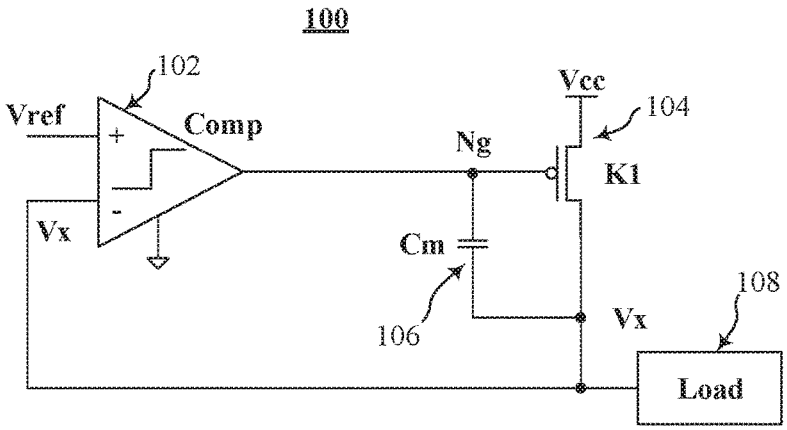
FIG. 1 illustrates a schematic circuit diagram of a low-dropout regulator in accordance with some embodiments of the present disclosure.

Referring to FIG. 1, a schematic circuit diagram of a low-dropout regulator is illustrated in accordance with some embodiments of the present disclosure. As shown, the low-dropout regulator (LDO) 100 includes a comparator (Comp) 102, a first switching transistor (K1) 104, and a Miller capacitor (Cm) 106.

A first input terminal of the comparator (Comp) 102 can be connected to a reference voltage (Vref). In some embodiments, the value of the reference voltage (Vref) can be determined based on the designed voltage of a load (Load) 108 of the low-dropout regulator (LDO) 100. For example, according to the type of the load (Load) 108 of the low-dropout regulator (LDO) 100, the value of the reference voltage (Vref) can be either fixed or variable. That is, the reference voltage (Vref) can be generated by a fixed voltage source, or can be generated by a circuit that can provide an adjustable voltage value.

A second input terminal of the comparator (Comp) 102 can be connected to a first terminal of the first switching transistor (K1) 104. An output terminal of the comparator (Comp) 102 can be connected to a control terminal of the first switching transistor (K1) 104.

A first terminal of the first switching transistor (K1) 104 can be connected to the load (Load) 108. A second terminal of the first switching transistor (K1) 104 can be connected to a power voltage (Vcc).

A first terminal of the Miller capacitor (Cm) 106 can be connected to the control terminal of the first switching transistor (K1) 104. A second terminal of the Miller capacitor (Cm) 106 can be connected to the first terminal of the first switching transistor (K1) 104, which is also connected to the load (Load) 108 and the output voltage (Vx).

In some embodiments, the first switching transistor (K1) 104 can be a metal-oxide-semiconductor field-effect transistor (MOSFET), such as a p-channel MOSFET as shown in FIG. 1. The control terminal of the first switching transistor (K1) 104 can be the gate of the MOSFET, and the first terminal and the second terminal of the first switching transistor (K1) 104 can be the source and drain of the MOSFET respectively.

The comparator (Comp) 102 can be any suitable voltage comparator, such as a tiny micropower, low voltage comparator in LTC6702, which is designed by Linear Technology Corporation. Since the bandwidth of the voltage comparator is higher than the operating bandwidth of an error operational amplifier that is used in the conventional LDO circuit, the bandwidth of the disclosed LDO is increased compared to the conventional LDOs.

In some embodiments, the load (Load) 108 can include one or more loads that are any suitable types, such as a capacitor type, a current source type, a resistance type, various combinations thereof, etc.

In an operation state of the LDO shown in FIG. 1, the comparator (Comp) 102 can compare the magnitudes of the reference voltage (Vref) and the output voltage (Vx) that is outputting to the load (Load) 108. When the output voltage (Vx) is higher than the reference voltage (Vref), the node (Ng) located at the control terminal of the first switching transistor (K1) 104 is at a high level, such as a logic signal "1." As such, the first switching transistor (K1) 104 is turned off, thus the load (Load) 108 consumes the power stored in the Miller capacitor (Cm) 106 to lower the output voltage (Vx). When the output voltage (Vx) is lower than the reference voltage (Vref), the node (Ng) is at a low level, such as a logic signal "0." As such, the first switching transistor (K1) 104 is turned on to conduct current to the load (Load) 108 to increase the output voltage (Vx). Therefore, the output voltage (Vx) can be stabilized at the reference voltage (Vref).

One distinction between the conventional LDO and the disclosed high-bandwidth LDO shown in FIG. 1 is that circuit 100 does not require an additional circuit structure to ensure the stability of the output. The Miller capacitor (Cm) 106 restrains the oscillation of the output voltage (Vx) to meet the power supply requirements of various load conditions.

Due to the Miller effect caused by the Miller capacitor (Cm) 106, when the noise of the output voltage (Vx) is too large, the oscillation variation is coupled to the node (Ng) through the Miller capacitor (Cm) 106. As such, the turning-on and turning-off of the first switching transistor (K1) 104 can be slowed down to reduce the oscillation of the output voltage (Vx), thereby correcting the nonlinear distortion of the output voltage (Vx). As such, the output voltage (Vx) can be stabilized within a certain range that is fit for the load (Load) 108.

It should be noted that, due to the local feedback control of the comparator (Comp) 102 and the Miller capacitor (Cm) 106 on the output voltage (Vx), a response speed of the disclosed LDO illustrated in FIG. 1 in response to a load dump can be significantly improved. For example, a response speed of a disclosed LDO including a Miller capacitor can be about 1 μs, while a response speed of a conventional LDO can be about 5 μs. That is, in response to a load dump, a response speed of the disclosed LDO is significantly faster than a response speed of a conventional analog LDO.

Further, the voltage slew rate of the disclosed LDO can be determined by the output voltage (Vx) and an equivalent capacitance of the load (Load) 108.

It should also be noted that, the capacitance value $C_x$ of the Miller capacitor (Cm) 106 is less than the capacitance value $C_{load}$ of the equivalent capacitance of the load (Load) 108. The capacitance value $C_x$ of the Miller capacitor (Cm) 106 is larger than the capacitance value $C_p$ of the parasitic capacitance at the control terminal of the first switching transistor (K1) 104. As such, it can be ensured that the noise of the output voltage (Vx) is coupled to the node (Ng) as much as possible to reduce the nonlinear distortion of the output voltage (Vx).

In some embodiments, assuming that the capacitance value $C_{load}$ of the equivalent capacitance of the load (Load) 108 and the capacitance value $C_p$ of the parasitic capacitance at the control terminal of the first switching transistor (K1) 104 are known, the capacitance value $C_x$ of the Miller capacitor (Cm) 106 can satisfy the following relational expressions: $100\ C_x \leq C_{load}$ and $C_x \geq 10\ C_p$. In such cases, approximately 90%-100% of the oscillation of the output voltage (Vx) can be coupled to the node (Ng). The noise of the output voltage (Vx) can be reduced by an order of magnitude, such as reducing from an original absolute noise amplitude at about 201 mV of a conventional analog LDO to an absolute noise amplitude at about 20 mV of the disclosed LDO. The resulting waveform of the output voltage (Vx) can meet the needs of a wider range of load conditions. Interpretation The comparator (Comp) of the disclosed LDO compares the voltage output from the first switch (K1) 104 to the load (Load) 108 and the reference voltage (Vref). The comparison result is transmitted to the control terminal of the first switching transistor (K1) 104, such that the LDO 100 has a high bandwidth that is not limited by any error operational amplifier.

Further, due to the Miller effect, the Miller capacitor can reduce the output oscillation of the first switching transistor, and reduce the output noise of the LDO, such that the waveform of the output can meet the requirements of various load conditions. Therefore, different from the existing analog LDO, the closed-loop of the disclosed high-bandwidth LDO can be non-stable. By using the Miller capacitor, the output oscillation of the first switching transistor can be stabilized within a certain range required by the load without limiting the LDO's bandwidth.

Therefore, the disclosed LDO can have a stable output, a high bandwidth, a fast load transient response speed. In addition, the disclosed LDO can consume less quiescent current (e.g., 1 μA) compared to a conventional LDO (e.g., 10 μA) to achieve same design specifications, such as power, noise, load dump, load regulation, linear regulation, etc.

Figure 2:
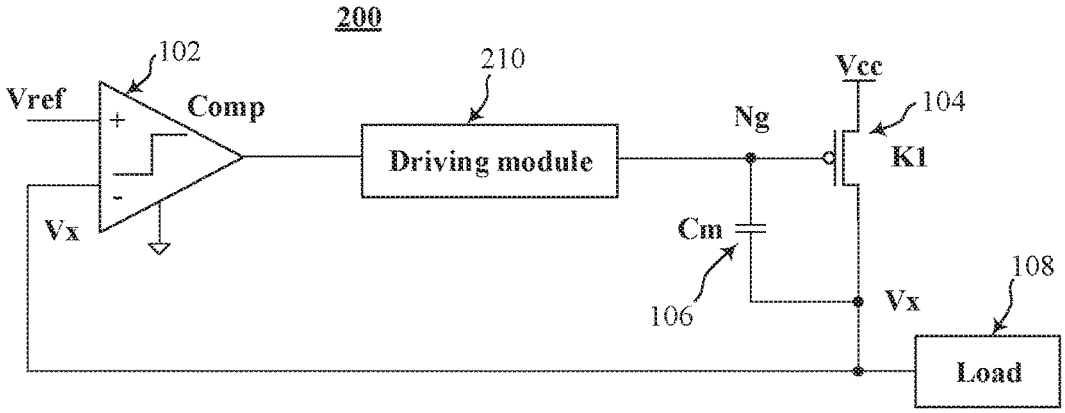
FIG. 2 illustrates a schematic structural diagram of another low-dropout regulator in accordance with some other embodiments of the present disclosure.

Referring to FIG. 2, a schematic structural diagram of another low-dropout regulator 200 is illustrated in accordance with some other embodiments of the present disclosure. Based on the structure of the LDO shown in FIG. 1, the disclosed LDO can further include a driving module 210 configured to drive the signal output by the comparator (Comp) 102 and transmitting the signal to the control terminal of the first switching transistor (K1) 104.

In some embodiments, the driving module 210 can enable the signal output by the comparator (Comp) 102 to meet the driving requirement of the first switching transistor (K1) 104. Further, in some embodiments, the driving module 200 can also buffer the signal transmitted to the first switching transistor (K1) 104 to improve the stability of the output of the LDO 200. It should be noted that, the driving module 210 can include any suitable circuit components. In the following, some exemplary implementation of the driving module 210 are described in connection with FIGS. 3-6.

Figure 3:
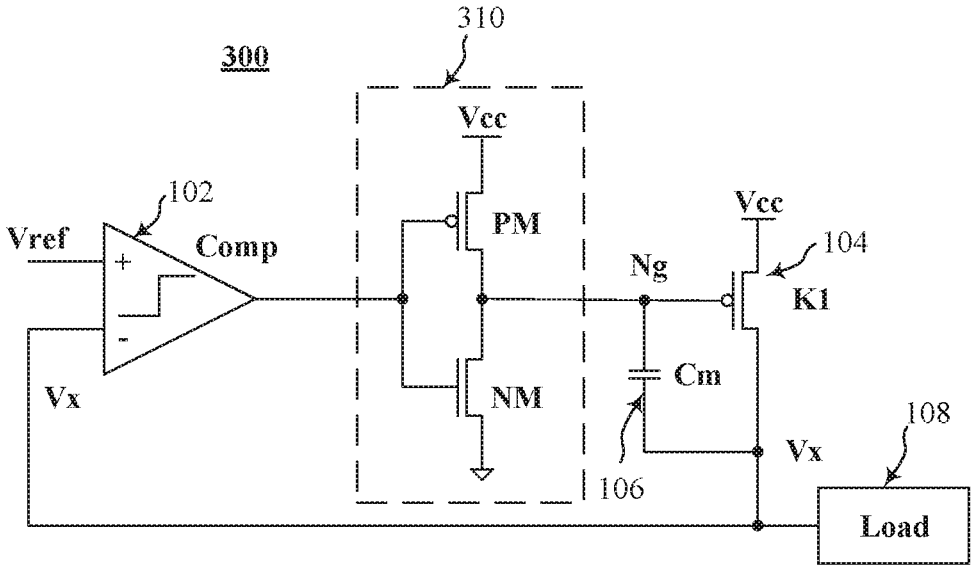
FIG. 3 illustrates a schematic circuit diagram of an implementation of the low-dropout regulator shown in FIG. 2.

Referring to FIG. 3, a schematic circuit diagram of one exemplary implementation of the low-dropout regulator shown in FIG. 2 is illustrated. In some embodiments, the driving module 310 can include a p-channel metal-oxide-semiconductor field-effect transistor (P-MOSFET, PM) and an n-channel metal-oxide-semiconductor field-effect transistor (N-MOSFET, NM).

The source of the P-MOSFET (PM) can be connected to the power supply voltage (Vcc). The drain of the P-MOSFET (PM) can be connected to the control terminal of the first switching transistor (K1) 104. The gate of the P-MOSFET (PM) can be connected to the output terminal of the comparator (Comp) 102. The gate of the N-MOSFET (NM) can be connected to the output terminal of the comparator (Comp) 102. The source of the N-MOSFET (NM) can be grounded. The drain of the N-MOSFET (NM) can be connected to the control end of the first switching transistor (K1) 104.

In some embodiments, the first switching transistor (K1) 104 is a P-MOSFET. The gate of the P-MOSFET can be connected to the output terminal of the driving module 310. The drain of the P-MOSFET can be connected to the load (Load) 108. The source of the P-MOSFET can be connected to the power voltage (Vcc). The non-inverting input terminal of the comparator (Comp) 102 can be connected to the reference voltage (Vref). The inverting input terminal of the comparator (Comp) 102 can be connected to the first terminal of the first switching transistor (K1) 104 (i.e., the drain of the P-MOSFET).

The driving module 310 is a complementary metal-oxide-semiconductor (CMOS) inverter. When the output of the comparator (Comp) 102 is at a high level, the voltage of the node (Ng) is pulled low to ground. And when the output of the comparator (Comp) 102 is at a low level, the voltage of the node (Ng) is pulled high to the power voltage (Vcc). This results in high noise margins.

Figure 4:
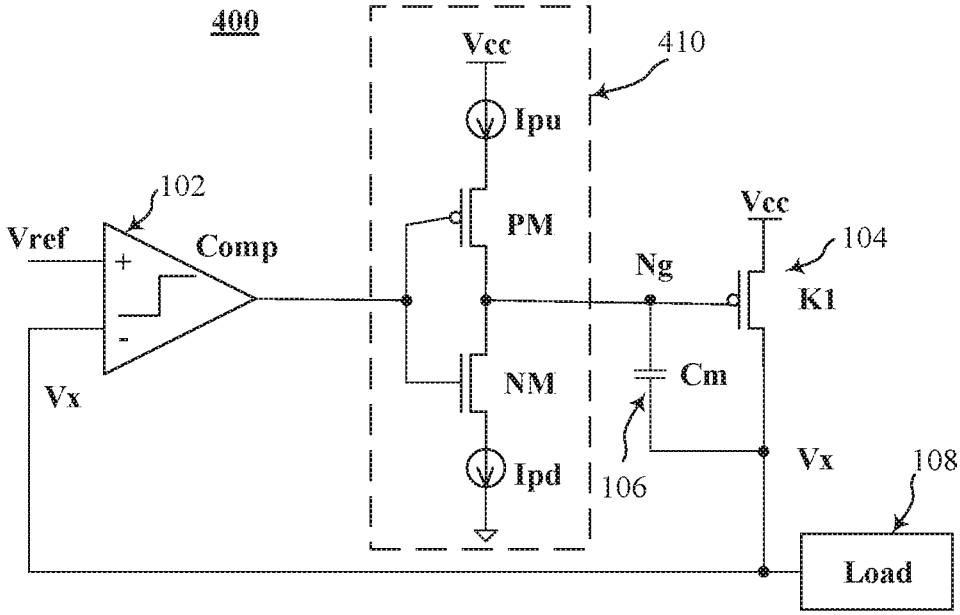
FIG. 4 illustrates a schematic circuit diagram of another implementation of the low-dropout regulator shown in FIG. 2.

Referring to FIG. 4, a schematic circuit diagram of another implementation of the low-dropout regulator shown in FIG. 2 is illustrated. In some embodiments, the driving module 410 can further include one or more constant current sources to limit the changing rate of the output voltage (Vx).

For example, as shown in FIG. 4, the driving module 100 can include a first current source (Ipu) and/or a second current source (Ipd). An input terminal of the first current source (Ipu) can be connected to the power voltage (Vcc). The output terminal of the first current source (Ipu) can be connected to the source of the P-MOSFET (PM). The input terminal of the second current source (Ipd) can be connected to the source of the N-MOSFET (NM). The output terminal of the second current source (Ipd) can be grounded.

The first current source (Ipu) can be used to limit a boost speed of the output voltage (Vx). The second current source (Ipd) can be used to limit a buck speed of the output voltage (Vx).

Figure 5:
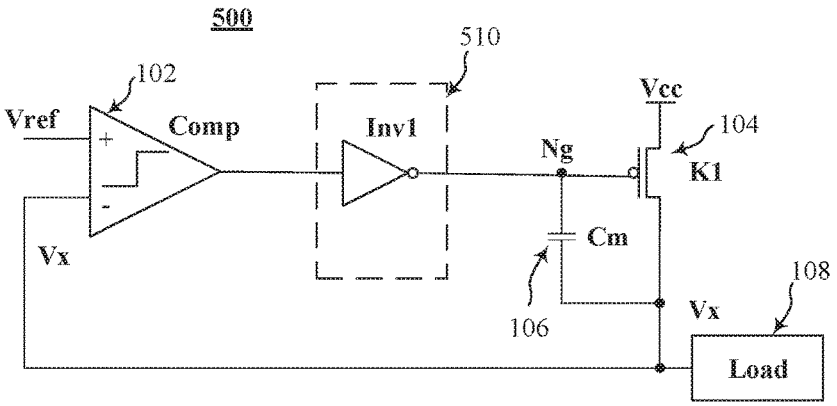
FIG. 5 illustrates a schematic circuit diagram of another implementation of the low-dropout regulator shown in FIG. 2.

Referring to FIG. 5, a schematic circuit diagram of another implementation of the low-dropout regulator shown in FIG. 2 is illustrated. In some embodiments, the driving module 510 can include one or more digital inverters.

For example, as shown in FIG. 5, the driving module 510 can include a first digital inverter (Inv1). The input terminal of the first digital inverter (Inv1) can be connected to the output terminal of the comparator (Comp) 102. The output terminal of the first digital inverter (Inv1) can be connected to the control terminal of the first switching transistor (K1) 104.

In some embodiments, the first switching transistor (K1) 104 can be a P-MOSFET. The gate of the P-MOSFET can be connected to the output terminal of the driving module 100. The drain of the P-MOSFET can be connected to the load (Load) 108. The source of the P-MOSFET can be connected to the power voltage (Vcc). The non-inverting input terminal of the comparator (Comp) 102 can be connected to the reference voltage (Vref). The inverting input terminal of the comparator (Comp) 102 can be connected to the first terminal of the first switching transistor (K1) 104 (i.e., the drain of the P-MOSFET).

The first digital inverter (Inv1) can be any suitable type of inverter, such as a current-non-compensating type inverter, an inverting buffer, an inverting amplifier, etc. A delay time and/or an amplification factor of the first digital inverter (Inv1) can be set according to the actual situation.

In some embodiments, a multi-stage amplifying or buffering structure can be applied. For example, the driving module 510 can further include a second digital inverter (not shown in FIG. 5). The input terminal of the second digital inverter can be connected to the output terminal of the comparator (Comp) 102. The output terminal of the second digital inverter can be connected to the input terminal of the first digital inverter (Inv1).

Figure 6:
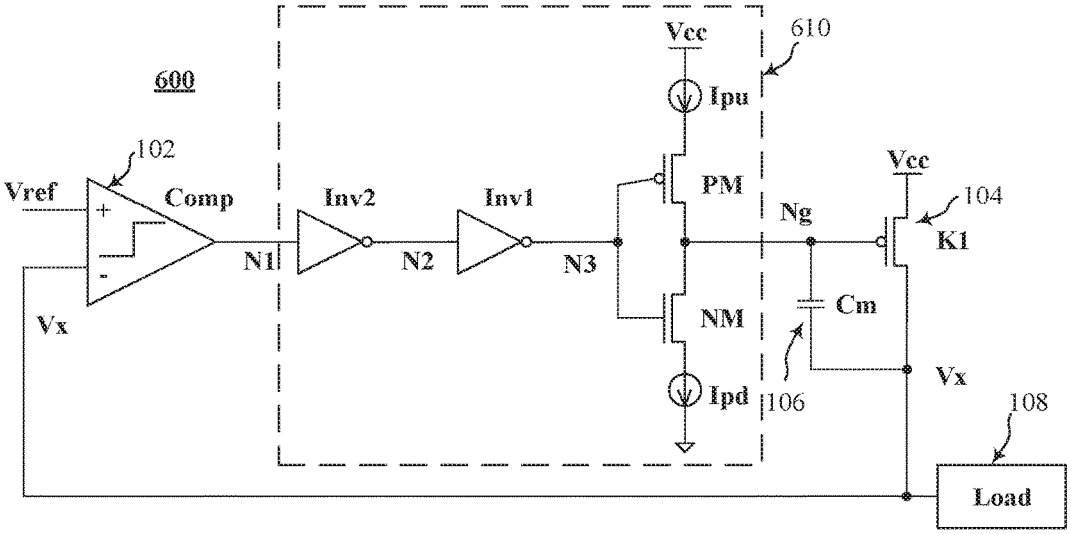
FIG. 6 illustrates a schematic circuit diagram of another implementation of the low-dropout regulator shown in FIG. 2.

Referring to FIG. 6, a schematic circuit diagram of another implementation of the low-dropout regulator shown in FIG. 2 is illustrated. The driving module 610 can include a first digital inverter (Inv1), a P-MOSFET (PM), and an N-MOSFET (NM).

The input terminal of the first digital inverter (Inv1) can be connected to the output terminal of the comparator (Comp) 102. The output terminal of the first digital inverter (Inv1) can be connected to the gate of the P-MOSFET (PM). The source of the P-MOSFET (PM) can be connected to the power voltage (Vcc). The drain of the P-MOSFET (PM) can be connected to the control terminal of the first switching transistor (K1) 104. The gate of the N-MOSFET (NM) can be connected to the output terminal of the first digital inverter (Inv1). The source of the N-MOSFET (NM) can be grounded. The drain of the N-MOSFET (NM) can be connected to the control terminal of the first switching transistor (K1) 104.

In some embodiments, the driving module 100 can further include a second digital inverter (Inv2). The input terminal of the second digital inverter (Inv2) can be connected to the output terminal of the comparator (Comp) 102. The output terminal of the second digital inverter (Inv2) can be connected to the input terminal of the first digital inverter (Inv1).

The first digital inverter (Inv1) and the second digital inverter (Inv2) can be any suitable type of inverters, including current-non-compensating type inverters, inverting buffers, inverting amplifiers, etc., as noted above.

In some embodiments, the first switching transistor (K1) 104 can be a P-MOSFET. The gate of the P-MOSFET can be connected to the output terminal of the driving module 610. The drain of the P-MOSFET can be connected to the load (Load) 108. The source of the P-MOSFET can be connected to the power voltage (Vcc). The non-inverting input terminal of the comparator (Comp) 102 can be connected to the reference voltage (Vref). The inverting input terminal of the comparator (Comp) 102 can be connected to the first terminal of the first switching transistor (K1) 104 (i.e., the drain of the P-MOSFET).

In some embodiments, the driving module 610 can further include a first current source (Ipu) and/or a second current source (Ipd). The input terminal of the first current source (Ipu) can be connected to the power voltage (Vcc). The output terminal of the first current source (Ipu) can be connected to the source of the P-MOSFET (PM). The input terminal of the second current source (Ipd) can be connected to the source of the N-MOSFET (NM). The output terminal of the second current source (Ipd) can be grounded.

The circuit topology shown in FIG. 6, for example, is used now to explain the working principle of the disclosed high-bandwidth LDO in detail. It can be assumed that node (N1) is located at the output terminal of the comparator (Comp) 102, node (N2) is located at the output terminal of the second digital inverter (Inv2), node (N3) is located at the output terminal of the first digital inverter (Inv1), and node (Ng) is located at the control terminal of the first switching transistor (K1) 104.

The comparator (Comp) 102 can compare the reference voltage (Vref) with the output voltage (Vx). When the output voltage (Vx) is higher than the reference voltage (Vref), the comparator (Comp) 102 can output a low level signal. As such, the node (N1) is at a low level, the node (N2) is at a high level, the node (N3) is at a low level. Thus, the P-MOSFET (PM) is turned on, and the N-MOSFET (NM) is turned off. The node (Ng) is at a high level, so that the first switching transistor (K1) 104 is turned off. Therefore, the load (Load) 108 consumes the power stored in the Miller capacitor (Cm), and the output voltage (Vx) is pulled low.

When the output voltage (Vx) drops below the reference voltage (Vref), the comparator (Comp) 102 can output a high level signal. As such, the node (N1) is at a high level, the node (N2) is at a low level, the node (N3) is at a high level. Thus, the P-MOSFET (PM) is turned off, and the N-MOSFET (NM) is turned on. The node (Ng) is at a low level, so that the first switching transistor (K1) 104 is turned on to conduct current to the output voltage (Vx). Therefore, the output voltage (Vx) is pulled up.

Due to the dynamic change of the circuit, the situation that the output voltage (Vx) is equal to the reference voltage (Vref) can be neglected. By repeating the above processes, the output voltage (Vx) can be dynamically stabilized at the reference voltage (Vref). It is noted that, in the circuit topology shown in FIG. 6, the node (Ng) is a dominant pole which dominates the transient response of the closed control loop of the LDO 600, while the node (N1), the node (N2), and the node (N3) are non-dominant poles.

Accordingly, low-dropout regulators are described. In some embodiments, a disclosed low-dropout regulator can comprise a first switching transistor configured to control a switching between a power supply and a load of the low-dropout regulator in response to a control signal, a comparator configured to compare an output voltage of the first switching transistor and a reference voltage, and the control signal is generated based on an output signal of the comparator, and a Miller capacitor electrically connected between a control terminal and an output terminal of the first switching transistor, and configured to stabilize an output voltage of the low-dropout regulator to the load.

The low-dropout regulator can further comprise a driving module configured to driving the output signal of the comparator to generate the control signal, to buffer the control signal for increasing a stability of the output voltage of the low-dropout regulator to the load. In some embodiments, the driving module can comprise a complementary metal-oxide-semiconductor (CMOS) inverter configured to increase noise margins of the output voltage of the low-dropout regulator to the load, and/or one or more digital inverters configured to amplify and/or to buffer the output signal of the comparator.

Further, the driving module can comprise one or more current sources configured to adjust a changing rate of the output voltage of the low-dropout regulator to the load, such as a first current source configured to limit a boost speed of the output voltage of the low-dropout regulator to the load, and/or a second current source configured to limit a buck speed of the output voltage of the low-dropout regulator to the load.

It is noted that, a capacitance value of the Miller capacitor is less than a capacitance value of an equivalent capacitance of the load, and is greater than a capacitance value of a parasitic capacitance at the control terminal of the first switching transistor. For example, the capacitance value of the Miller capacitor is less than or equal to one percent of the capacitance value of the equivalent capacitor of the load, and is greater than or equal to ten times of the capacitance value of the parasitic capacitance at the control terminal of the first switching transistor.

In some embodiments, the low-dropout regulator further has a dominant pole at the control terminal of the first switching transistor configured to dominate a transient response of the low-dropout regulator.

In some embodiments, the disclosed high-bandwidth LDO can ensure an output load up to 50 mA by using a Miller capacitor with a withstand voltage of about 100 mV and a capacitance of about 400 pF, when the power voltage (Vcc) is about 1.2V and the reference voltage (Vref) is about 0.1V. It is noted that, each of the embodiments of the disclosed high-bandwidth LDO described above in connection with FIGS. 1-6 can either be used separately as a single circuit, or can be used as a portion of circuit that is integrated to another circuit.

Figure 7:
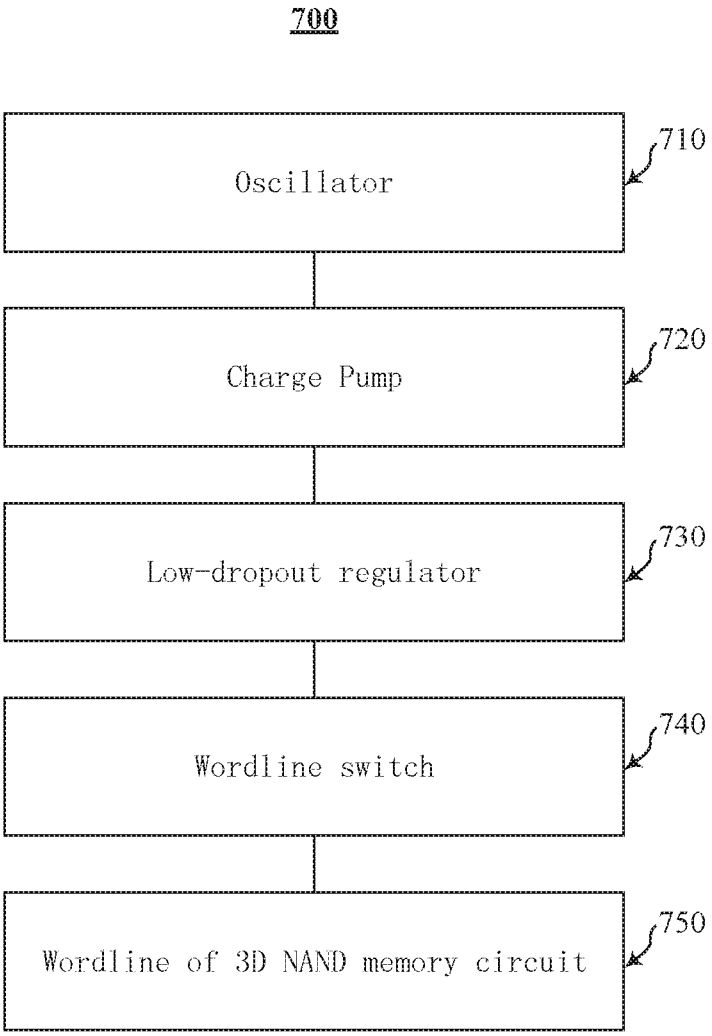
FIG. 7 illustrates a schematic block diagram of an exemplary system for implementing a disclosed low-dropout regulator in a three-dimensional (3D) NAND memory device in accordance with some embodiments of the present disclosure.

Referring to FIG. 7, a schematic block diagram of an exemplary system for implementing a disclosed low-dropout regulator in a three-dimensional (3D) NAND memory device is shown in accordance with some embodiments of the present disclosure.

3D NAND flash memory devices are widely adopted in mobile applications such as a smartphone, tablet PC, MP3 player, digital camera, notebook and so on. Since the battery lifetime is one of the important factors in mobile devices, low-power design must be considered. Normally, 3D NAND flash memories receive a single supply voltage such as 3.3V or 1.8V, and wide range high output voltage which are required for staircase linear program operations such as read, program and erase operations. Typical NAND flash memory consumes large current during program operations due to the simultaneous operation of several high-voltage generators.

An exemplary system 700 for supplying power to a word line of a 3D NAND flash memory device is shown in FIG. 7. As illustrated, the system 700 can include an oscillator 710, a charge pump 720, a low-dropout regulator 730, a word line (WL) switch 740, and a word line in a 3D NAND memory circuit.

The system 700 provides the 3D NAND flash memory device with wide range output voltage to support staircase linear program operations. Since the system 700 has high output regulated voltage such as 25V and a fast rising time for an arbitrary load capacitance, the charge pump 720 can be used to elevate a supplied voltage to a higher voltage. The oscillator 710 can be used to generate periodic clock signals and provide driving signals to the charge pump 720.

The low-dropout regulator 730 can be any one of the disclosed LDOs described above in connection with FIGS. 1-6. The low-dropout regulator 730 can be used to draw large current and low output regulated voltage for a staircase program pulse. The output of the low-dropout regulator 730 can be used to drive a selected word line 750 through a word line switch 740 during a program operation in the 3D NAND flash memory device.

The provision of the examples described herein (as well as clauses phrased as "such as," "e.g.," "including," and the like) should not be interpreted as limiting the claimed subject matter to the specific examples; rather, the examples are intended to illustrate only some of many possible aspects.

Further, the words "first", "second" and the like used in this disclosure do not denote any order, quantity or importance, but are merely intended to distinguish between different constituents. The words "comprise" or "include" and the like mean that the elements or objects preceding the word can cover the elements or objects listed after the word and their equivalents, without excluding other elements or objects. The words "connect" or "link" and the like are not limited to physical or mechanical connections, but may include electrical connections, either directly or indirectly.

Although the present disclosure has been described and illustrated in the foregoing illustrative embodiments, it is understood that the present disclosure has been made only by way of example, and that numerous changes in the details of embodiment of the present disclosure can be made without departing from the spirit and scope of the present disclosure, which is only limited by the claims which follow. Features of the disclosed embodiments can be combined and rearranged in various ways. Without departing from the spirit and scope of the present disclosure, modifications, equivalents, or improvements to the present disclosure are understandable to those skilled in the art and are intended to be encompassed within the scope of the present disclosure.

What is claimed is:

1. A low-dropout regulator, comprising:

a first switching transistor comprising a first terminal, a second terminal and a control terminal, wherein the first terminal of the first switching transistor is connected to a load, and the second terminal of the first switching transistor is connected to a power supply voltage;

a comparator comprising a first input terminal, a second input terminal and an output terminal, wherein the first input terminal of the comparator is connected to a reference voltage, the second input terminal of the comparator is connected to the first terminal of the first switching transistor;

a driving module comprising an input and an output, wherein the input of the driving module is coupled to the output terminal of the comparator, and the output of the driving module is coupled to the control terminal of the first switching transistor; and a Miller capacitor comprising a first terminal and a second terminal, wherein the first terminal of the Miller capacitor is commonly connected to the control terminal of the first switching transistor and the output of the driving module, and the second terminal of the Miller capacitor is connected to the first terminal of the first switching transistor and the load.

2. The low-dropout regulator of claim 1, wherein the driving module further comprises:

a p-channel metal-oxide-semiconductor field-effect transistor (P-MOSFET), wherein a source of the P-MOSFET is connected to the power supply voltage, a drain of the P-MOSFET is connected to the control terminal of the first switching transistor, and a gate of the P-MOSFET is connected to the output terminal of the comparator; and a n-channel metal-oxide-semiconductor field-effect transistor (N-MOSFET), wherein a gate of the N-MOSFET is connected to the output terminal of the comparator, a source of the N-MOSFET is coupled to a ground voltage potential, and a drain of the N-MOSFET is connected to the control terminal of the first switching transistor.

3. The low-dropout regulator of claim 1, wherein the driving module further comprises:

a first inverter comprising an input terminal and an output terminal, wherein the input terminal of the first inverter is connected to the output terminal of the comparator, and the output terminal of the first inverter is connected to the control terminal of the first switching transistor.

4. The low-dropout regulator of claim 1, wherein the driving module further comprises:

a p-channel metal-oxide-semiconductor field-effect transistor (P-MOSFET), wherein a drain of the P-MOSFET is connected to the control terminal of the first switching transistor, and a gate of the P-MOSFET is connected to the output terminal of the comparator;

a first current source, wherein an input terminal of the first current source is connected to the power supply voltage, and an output terminal of the first current source is connected to the source of the P-MOSFET;

a n-channel metal-oxide-semiconductor field-effect transistor (N-MOSFET), wherein a gate of the N-MOSFET is connected to the output terminal of the comparator, a source of the N-MOSFET is coupled to a ground voltage potential, and a drain of the N-MOSFET is connected to the control terminal of the first switching transistor; and a second current source, wherein an input terminal of the second current source is connected to the source of the N-MOSFET, and an output terminal of the second current source is coupled to a ground voltage potential.

5. The low-dropout regulator of claim 4, wherein the driving module further comprises:

a first inverter comprising an input terminal and an output terminal, wherein the input terminal of the first inverter is connected to the output terminal of the comparator, and the output terminal of the first inverter is connected to the gate of the P-MOSFET and the gate of the N-MOSFET.

6. The low-dropout regulator of claim 3, wherein the driving module further comprises:

a second inverter, wherein an input terminal of the second inverter is connected to the output terminal of the comparator, and an output terminal of the second inverter is connected to the input terminal of the first inverter.

7. The low-dropout regulator of claim 3, wherein:

the first inverter comprises an inverting buffer or an inverting amplifier.

8. The low-dropout regulator of claim 1, wherein:

a capacitance value of the Miller capacitor is less than a capacitance value of an equivalent capacitance of the load, and is greater than a capacitance of a parasitic capacitance at the control terminal of the first switching transistor.

9. The low-dropout regulator of claim 1, wherein:

the first switching transistor comprises a p-channel metal-oxide-semiconductor field-effect transistor (P-MOSFET).

10. The low-dropout regulator of claim 1, wherein:

the first terminal of the first switching transistor is a non-dominant pole; and the control terminal of the first switching transistor is a dominant pole.

11. A low-dropout regulator, comprising:

a first switching transistor configured to control a switching between a power supply and a load of the low-dropout regulator in response to a control signal;

a comparator configured to compare an output voltage of the first switching transistor and a reference voltage, wherein the control signal is generated based on an output signal of the comparator;

a driving module configured to drive the output signal of the comparator to generate the control signal, and to buffer the control signal for increasing stability of the output voltage of the low-dropout regulator to the load; and a Miller capacitor comprising a first terminal and a second terminal, wherein the first terminal of the Miller capacitor is commonly connected to a control terminal of the first switching transistor and an output of the driving module, and the second terminal of the Miller capacitor is connected to an output terminal of the first switching transistor, and the Miller capacitor is configured to stabilize an output voltage of the low-dropout regulator to the load.

12. The low-dropout regulator of claim 11, wherein the driving module comprises:

a complementary metal-oxide-semiconductor (CMOS) inverter configured to increase noise margins of the output voltage of the low-dropout regulator to the load.

13. The low-dropout regulator of claim 11, wherein the driving module comprises:

one or more current sources configured to adjust a changing rate of the output voltage of the low-dropout regulator to the load.

14. The low-dropout regulator of claim 13, wherein the one or more current sources comprise:

a first current source configured to limit a boost speed of the output voltage of the low-dropout regulator to the load.

15. The low-dropout regulator of claim 14, wherein the one or more current sources further comprise:

a second current source configured to limit a buck speed of the output voltage of the low-dropout regulator to the load.

16. The low-dropout regulator of claim 11, wherein the driving module comprises:

one or more digital inverters configured to amplify or buffer the output signal of the comparator.

17. The low-dropout regulator of claim 11, wherein:

a capacitance value of the Miller capacitor is less than a capacitance value of an equivalent capacitance of the load, and is greater than a capacitance value of a parasitic capacitance at the control terminal of the first switching transistor.

18. The low-dropout regulator of claim 11, further comprising:

a dominant pole at the control terminal of the first switching transistor configured to dominate a transient response of the low-dropout regulator.

* * * * *